United States Patent [19]

Sperzel et al.

[11] Patent Number: 5,045,006

[45] Date of Patent: Sep. 3, 1991

[54] FOOT LOOP FOR A WINDSURFING BOARD

[75] Inventors: Robert Sperzel, Surheim, Fed. Rep. of Germany; Wolfgang Berndorfer, Neukirchen/Walde, Austria

[73] Assignee: Alpha International Gesellschaft m.b.H., Salzburg, Austria

[21] Appl. No.: 427,257

[22] Filed: Oct. 25, 1989

[30] Foreign Application Priority Data

Nov. 2, 1988 [AT] Austria ..... 2689/88

[51] Int. Cl.[5] ..... B63B 35/79

[52] U.S. Cl. ..... 441/75; 114/39.2; 24/68 SK

[58] Field of Search ..... 114/39.2; 441/70, 75; 5/443, 444; 24/68 SK

[56] References Cited

U.S. PATENT DOCUMENTS

| | | | |
|---|---|---|---|
| 2,933,741 | 4/1960 | Walter | 441/70 |
| 3,689,092 | 9/1972 | Lake | 441/70 |
| 4,822,310 | 4/1989 | Parker et al. | 441/70 |
| 4,846,744 | 7/1989 | Love | 441/75 |

FOREIGN PATENT DOCUMENTS

| | | | |
|---|---|---|---|
| 380445 | 9/1984 | Austria . | |
| 2287251 | 5/1976 | France | 441/70 |

*Primary Examiner*—Sherman Basinger
*Assistant Examiner*—Thomas J. Brahan
*Attorney, Agent, or Firm*—Collard, Roe & Galgano

[57] ABSTRACT

A foot loop for a windsurfing board comprises a loop strip, which arches between two holders, which are adapted to be secured to the top surface of the board at spaced apart locations. The strip is adjustable to change the length of its arched portion and is preferably provided with upholstery. To provide a foot loop which can easily be manipulated and can exactly be adapted to the foot, at least one of the holders comprises an eyelet and the strip and disposed adjacent to said one holder is constituted by a freely terminating strap, which is threaded through said eyelet and is folded about said one holder and is detachably fixed in any of different positions to the top surface of the loop strip or of its upholstery in the arched portion of the loop.

2 Claims, 1 Drawing Sheet

FOOT LOOP FOR A WINDSURFING BOARD

BACKGROUND OF THE INVENTION

1. Field of the Invention

This invention relates to a foot loop for a windsurfing board, which foot loop comprises of a loop strip, which arches between two holders, which are adapted to be secured to the surface of the board at spaced apart locations, and which strip is adjustable to change the length of its arched portion and is preferably provided with upholstery.

2. Description of the Prior Art

Foot loops are mounted on the windsurfing board in a suitable position and are intended to ensure a high stability of the windsurfer on the board. For this reason a proper fit of the foot in the foot loop is of high significance. The foot loop comprises a plastic strip and in most cases a flexible upholstering tubing, through which the plastic strip extends. It is necessary to permit an adjustment of the width of the loop to the foot of the windsurfer. If the loop strip consists of one piece, that adjustment is effected in that the loop strip is detached from tis fixing means and is then adjusted and subsequently fixed again. As a result, the strip can be adjusted in length only to a small extent and the adjustment involves a complicated and time-consuming manipulation and can be effected only in steps and the proper fit cannot be checked during the adjustment. In order to permit an improved adjustment of the loop, most loop strips consist of two or three sections so that the sections of the strip can be interconnected by tuft fasteners or Velcro fasteners in positions corresponding to different lengths of the strip. But even in that case the adjustment of the width of the loop involves a rather complicated manipulation of the loop strip, particularly if the loop comprises an upholstering tubing, because the upholstering tubing must be backfolded or opened before the adjustment, then the strip sections must be separated and joined in the desired position, and the upholstering tubing must be restored before the proper fit can be checked. If the fit is not satisfactory, the entire adjusting operation must be repeated. In that case too it is difficult to adjust the width of the loop and a repeated adjustment of the loop strip is required in most cases.

SUMMARY OF THE INVENTION

For this reason it is an object of the invention to eliminate said disadvantages and to provide a foot loop which is of the kind described first hereinbefore, can be manufactured and mounted at low cost and distinguishes in that it can infinitely be adjusted through a large range in a simple and convenient manner.

That object is accomplished in accordance with the invention in that at least one of the two holder comprises an eyelet and one end of the strip is constituted by a freely terminating strap which is adapted to be threaded through said eyelet and to be backfolded around that eyelet and to be fixed in various positions to the top surface of the loop strip or of the upholstering tubing in the arched portion of the loop. In that case the foot loop can be adjusted in that the strap is detached from the arched portion of the strip and is pulled or displaced to a desired extent in order to adapt the width of the loop to the foot which is inserted into the loop. The strap is then again backfolded and secured to the top surface of the strip or of the upholstering tubing so that the loop has exactly been adjusted in adaptation to the foot to be held. The loop can be adjusted without any manipulation of the upholstering tubing and because the loop is directly adjusted to the inserted foot the adjustment will immediately result in a proper size of the loop. The strip and the holder permit the kind and design of the upholstering tubing, the strip, and the fastener to be selected as desired and because the range of the adjustment is independent of the upholstering tubing that upholstering tubing can greatly be simplified and improved.

If the loop strip is made in one piece and terminates in straps at both ends and if both holders comprise eyelets, the loop can be made at low cost and can be adjusted within a large range. In that case it will be possible to change the shape of the loop and the position of the upholstering tubing in that both straps are displaced in the same sense.

In another embodiment of the invention the loop strip is composed of two strip sections, which overlap each other throughout the arched portion, and each strip section is secured at one end and is provided at the other end with a freely terminating strap and each holder for fixing one end of one strip section comprises an eyelet for receiving the strap of the other strip section. The resulting loop will be strong and adapted to resist a high load and will have an intermediate arched portion in which the two strip sections overlap to stabilize the loop in its shape whereas the adjusting operation or the range of adjustment will not be restricted.

If the strip sections overlap in surface contact with each other in the intermediate portion and are provided with interfitting sliding guides, a lateral slipping of the strip sections will be prevented even under high loads and the strip will always be in a proper position and its sections will easily be slidable.

Within the scope of the invention it will be desirable to provide the loop strip or the upholstering tubing on its top surface with Velcro fasterners for a fixation of the strap or straps because it will easily be possible in that case to fix and detach the strap or straps for an adjustment of the loop and an infinite adjustment will be permitted throughout the range of adjustment.

DETAILED DESCRIPTION OF THE PREFERRED EMBODIMENTS

Figure 1:
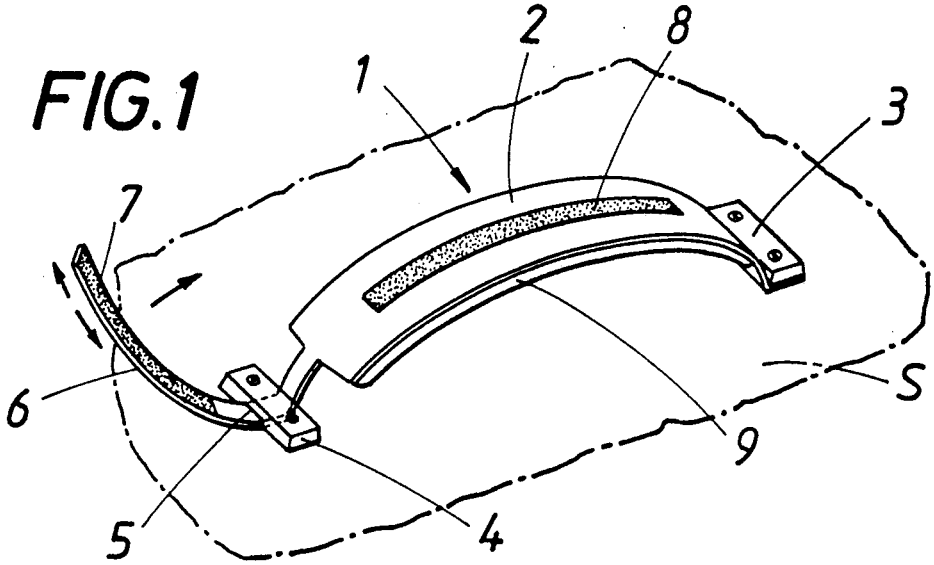
FIG. 1 is a perspective view showing an illustrative embodiment of a foot loop in accordance with the invention.

The embodiment shown in FIG. 1 constitutes a foot loop 1 which can easily be manipulated and is infinitely adjustable and exactly adaptable to the shape of a given foot. The foot loop 1 comprises a one-piece loop strip 2, which consists of plastic and is secured by means of two holders 3, 4 in a desired position to the top surface of a windsurfing board S, which is only diagrammatically indicated. The holder 3 serves for a permanent fixation of one end of the strip. The other holder 4 comprises an eyelet 5, through which a freely terminating strap 6 at the other end of the strip is threaded. The strap can be moved in the eyelet 5 in one direction or the other to change the length of the arched intermediate portion of the loop strip between the holders 3, 4. The strap 6 can be backfolded and can be secured to the top surface of the strip to fix the loop in its adjusted length. For that purpose the confronting surfaces of the strap 6 and of the strip 2 are provided with respective parts 7, 8 of a Velcro fastener, which permits the strap 6 to be secured to the loop strip 2 in any desired position of the fastener and which can be opened and closed by a single manipulation. That foot loop 1 can quickly and conveniently be adjusted while the foot has been inserted into the loop 1 so that the loop can be adjusted in direct adaptation to the foot. During the adjustment of the loop 1 the upholstery which has been provided, e.g., a upholstery layer 9 which has adhesively been bonded to the strip on its inside surface, will not be changed so that such upholstery cannot subsequently exert an adverse effect on the fit of the loop. On the contrary, the upholstery 9, its position, shape and arrangement will necessarily be taken into account as the loop is adapted to a given foot.

Figure 2:
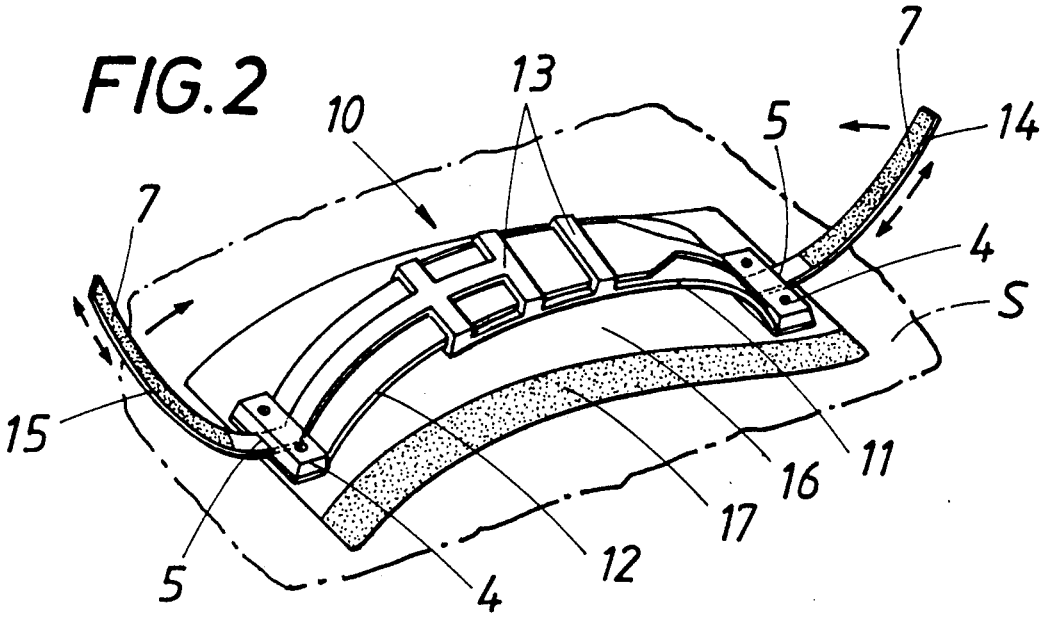
FIGS. 2 and 3 are perspective views showing another illustrative embodiment of a foot loop in accordance with the invention in open and closed positions, respectively.
Figure 3:
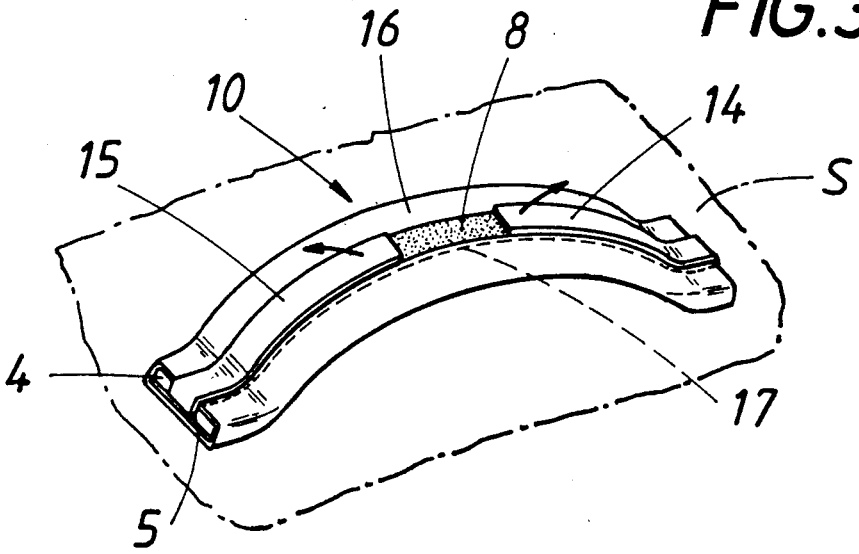

In the illustrative embodiment shown in FIGS. 2 and 3 the foot loop 10 is constituted by a two-part loop strip, which comprises two strip sections 11, 12, which throughout the arched portion overlap in surface contact with each other and are provided with interfitting sliding guides 13. Each strip section 11 or 12 is permanently secured to the windsurfing board S at one end and at the other end is provided with a strap 14 or 15. Each holder 4 is permanently fixed to one strip section and comprises an eyelet 5 through which the strap 14 or 15 of the other strip section is threaded. Each or both of the straps 14 and 15 can be moved in one direction or the other to shift the strip sections 11, 12 relative to each other along the sliding guides 13 so that the length of the arched portion of the loop can be changed and the foot loop 10 can be adjusted as desired. The illustrated foot loop 10 is provided with an upholstering tubing 16, which can be opened and closed by means of a Velcro fastener 17 so that the fixation and replacement of the tubing will be simplified. The tubing 16 is also connected to the holders 4. The straps 14 and 15 are adapted to be fixed by Velcro fasteners 7, 8. Each of said fasteners comprises one part 7 which is secured to the strap 14 or 15 and another part 8 which is secured to the top surface of the upholstering tubing 16.

In FIG. 3 the foot loop 10 is shown in position for use. For a readjustment of the foot loop 10 it will be sufficient to detach one or both of the straps 14 and 15 and to move said strap or straps so that the loop provided with the upholstering tubing 16 is adapted to the foot which has been inserted into the loop 10. When the strap or straps has or have then been backfolded and fixed in position the foot loop 10 will be fixed in its new length so that the desired adaptation has been effected. Whereas FIG. 2 shows that the upholstering tubing 16 can be opened, in order that the structure of the loop is rendered more clearly apparent, the upholstering tubing 16 need not be opened for an adjustment of the foot loop 10.

We claim:

1. In a foot loop for a windsurfing board including:

a loop strip having a first strip section, with an end portion and a second strip section with an end portion and an arched intermediate portion of adjustable length between said first and second end portions, said strip sections overlapping throughout said intermediate portion, said intermediate portion having a top surface, two holders, each of which is in the shape of an eyelet, for fixing said first and second end portions of said strip to the top surface of a windsurfing board at two spaced-apart locations, said first strip section being secured at one end to one of said holders and is provided at its other end with a strap, which is threaded through the eyelet of the other of said holders, said second strip section being secured at one end to said other holder and is provided at its other end with a strap, which is threaded through the eyelet of said one holder, each of said straps is backfolded around the associated eyelet to overlie said top surface of said intermediate portion, and fastening means are provided for detachably fastening each of said straps to said top surface of said intermediate portion in any of a plurality of positions corresponding to different lengths of said intermediate position.

2. The foot loop for a windsurfing board as claimed in claim 1, wherein said improvement additionally includes:

said strip sections in surface contact with each other in said intermediate portion and said strip sections provided with interfitting sliding guides.

* * * * *